US009156596B2

(12) United States Patent
Moreau

(10) Patent No.: US 9,156,596 B2
(45) Date of Patent: Oct. 13, 2015

(54) FLUID PRODUCT DISPENSING HEAD

(75) Inventor: Francis Moreau, Sotteville les Rouen (FR)

(73) Assignee: APTAR FRANCE SAS, Le Neubourg (FR)

( * ) Notice: Subject to any disclaimer, the term of this patent is extended or adjusted under 35 U.S.C. 154(b) by 195 days.

(21) Appl. No.: 13/993,895

(22) PCT Filed: Jan. 24, 2012

(86) PCT No.: PCT/FR2012/050149
§ 371 (c)(1),
(2), (4) Date: Jun. 13, 2013

(87) PCT Pub. No.: WO2012/101372
PCT Pub. Date: Aug. 2, 2012

(65) Prior Publication Data

US 2013/0256338 A1 Oct. 3, 2013

(30) Foreign Application Priority Data

Jan. 27, 2011 (FR) ..... 11 50647

(51) Int. Cl.
*B67B 1/00* (2006.01)
*B65D 88/54* (2006.01)
(Continued)

(52) U.S. Cl.
CPC ..... *B65D 47/247* (2013.01); *B05B 11/0029* (2013.01); *B05B 11/30* (2013.01);
(Continued)

(58) Field of Classification Search
CPC .. B65D 47/247; B65D 50/045; B65D 83/222; B65D 83/205; B65D 83/38; B65D 47/286; B05B 11/3059; B05B 11/3001; B05B 11/3057; F16N 3/12; G01F 11/021; A62C 11/005
USPC ..... 222/153.13, 256, 559, 321.7, 153.11, 222/153.04, 153.14, 309, 384, 321.8, 321.9, 222/321.1, 402.1, 402.12, 402.13, 402.11, 222/389, 394
See application file for complete search history.

(56) References Cited

U.S. PATENT DOCUMENTS 3,913,804 A 10/1975 Laauwe
3,990,640 A 11/1976 Laauwe
(Continued)

FOREIGN PATENT DOCUMENTS

EP 1 310 437 A1 5/2003
FR 2 857 342 A1 1/2005
WO 93/01100 A1 1/1993

OTHER PUBLICATIONS

English translation of the International Preliminary Report on Patentability for PCT/FR2012/050149.
International Search Report for PCT/FR2012/050149 dated May 24, 2012.

*Primary Examiner* — Kevin P Shaver
*Assistant Examiner* — Stephanie E Williams
(74) *Attorney, Agent, or Firm* — Sughrue Mion, PLLC

(57) ABSTRACT

A fluid dispenser head (T) for associating with a fluid dispenser member (P), such as a pump, the head (T) forming a dispenser duct (12) that communicates upstream with an outlet (S) of the dispenser member (P), and downstream with a dispenser orifice (31), the head (T) further including a shutter (2) for selectively closing the dispenser duct (12), the shutter (2) being movable in the duct (12) along a movement axis between a closed position and a dispensing position, the head (T) further including a thrust element (42) so as to thrust the shutter (2) towards its closed position, said dispenser head being characterized in that the thrust element (42) is movable substantially perpendicularly and tangentially to the movement axis of the shutter (2).

13 Claims, 2 Drawing Sheets

(51) Int. Cl.

| | |
|---|---|
| ***B05B 11/00*** | (2006.01) |
| ***B65D 83/00*** | (2006.01) |
| ***B65D 47/24*** | (2006.01) |
| ***B65D 83/20*** | (2006.01) |
| ***B65D 83/22*** | (2006.01) |
| ***B65D 83/56*** | (2006.01) |

(52) U.S. Cl.

CPC ..... *B05B 11/306* (2013.01); *B05B 11/3053* (2013.01); *B05B 11/3057* (2013.01); *B65D 83/205* (2013.01); *B65D 83/207* (2013.01); *B65D 83/22* (2013.01); *B65D 83/56* (2013.01)

(56) References Cited

U.S. PATENT DOCUMENTS

| | | | | |
|---|---|---|---|---|
| 6,991,139 | B2 | 1/2006 | Garcia et al. | |
| 7,874,465 | B2 * | 1/2011 | Bertin et al. | 222/402.12 |
| 2008/0217359 | A1 * | 9/2008 | Bougamont | 222/153.13 |
| 2009/0071985 | A1 * | 3/2009 | Ki | 222/309 |
| 2009/0120963 | A1 * | 5/2009 | Bae | 222/153.13 |
| 2010/0224652 | A1 | 9/2010 | Lim | |

* cited by examiner

FLUID PRODUCT DISPENSING HEAD

CROSS REFERENCE TO RELATED APPLICATIONS

This application is a National Stage of International Application No. PCT/FR2012/050149 filed Jan. 24, 2012, claiming priority based on French Patent Application No. 11 50647 filed Jan. 27, 2011, the contents of all of which are incorporated herein by reference in their entirety.

The present invention relates to a fluid dispenser head for associating with a dispenser member, such as a pump or a valve. The head forms a dispenser duct that communicates upstream with an outlet of the pump or of the valve, and downstream with a dispenser orifice. The head further includes a shutter for selectively closing the dispenser duct, the shutter being movable in the feed duct between a closed position and a dispensing position. Such a dispenser head can be used in particular in the fields of perfumery, cosmetics, and pharmacy, in association with a pump or a valve. The present invention also relates to a dispenser comprising a reservoir, a pump or a valve, and a dispenser head of the invention.

In the prior art, two main types of shutter are known for fluid dispenser heads. The first type of shutter may be referred to as an external shutter, in that it closes the dispenser duct and/or the dispenser orifice from the outside. Generally, the user must act on the shutter so as to open the dispenser orifice and thus enable the dispenser to be used. The second type of shutter may be referred to as an internal shutter, in that it is incorporated inside the dispenser head. In this configuration, the shutter is often positioned in the dispenser duct and is moved inside the duct in such a manner as to close and open the duct and/or the dispenser orifice selectively. Either way, it may be considered that the dispenser orifice forms part of the dispenser duct. Most internal or incorporated shutters are arranged entirely inside the dispenser head, and are thus not accessible from the outside. In order to enable the shutter to move inside the dispenser duct, use is generally made of the pressure of the fluid to be dispensed, such that the shutter behaves like a piston. When the fluid under pressure coming from the outlet of the dispenser member arrives in the dispenser duct, it moves the shutter, thereby opening the dispenser duct and/or the dispenser orifice. The user does not need to act on the shutter: usually, the user is not even aware that a shutter is incorporated in the dispenser head.

Whether the shutter is an external shutter or an internal shutter, they both present drawbacks. An external shutter requires the user to act in a way that is often tricky. Furthermore, a residue of fluid is always present on the shutter, such that it may dirty the user's hands or clothes. An internal shutter requires precision manufacturing of a complex part. Furthermore, sometimes the shutter jams inside the dispenser duct.

There also exist shutters having self-sealing slots comprising two flexible lips that are in leaktight contact at rest, and that move apart under the pressure of the fluid. By way of example, document FR 2 857 342 may be mentioned. That type of slot shutter may produce acceptable closure, by setting the lips back from the slot, but a considerable actuation force is then necessary to depress the pusher of the pump.

In the prior art, U.S. Pat. Nos. 3,990,640 and 3,913,804 are also known that describe a shutter provided with a thrust element in the form of a screw-cap that moves along the movement axis of the shutter. The user must thus tighten the cap fully so as to lock the shutter, and unscrew it so as to be able to use the dispenser. Those actions constitute specific operations that the user will quickly forget to do.

An object of the present invention is to remedy the above-mentioned drawbacks of shutters of the prior art by defining a novel type of shutter that opens and closes in a different way and that may involve other operations that are easier to perform.

To do this, the present invention proposes a fluid dispenser head for associating with a fluid dispenser member, such as a pump, the head forming a dispenser duct that communicates upstream with an outlet of the dispenser member, and downstream with a dispenser orifice, the head further including a shutter for selectively closing the dispenser duct, the shutter being movable in the duct along a movement axis between a closed position and a dispensing position, the head further including a thrust element so as to thrust the shutter towards its closed position, the thrust element being movable substantially perpendicularly to the movement axis of the shutter.

In the context of the present invention, it should be well understood that the thrust element formed by the head is not constituted by the user's hand. Nor is the thrust element incorporated with the shutter. The thrust element is not a spring incorporated with, or acting on, the shutter. On the contrary, the thrust element is a part of the head that is distinct from the shutter.

Thus, the shutter is driven from the outside by a thrust element that is moved directly or indirectly by the user. The shutter of the present invention thus combines the characteristics both of the internal shutter, in that the shutter is arranged inside the dispenser duct, and of the external shutter, in that a portion of the shutter is accessible to the thrust element. Naturally, the thrust element is advantageously situated outside the feed duct.

In an advantageous aspect of the present invention, the thrust element is movable tangentially in turning relative to the shutter.

Advantageously, the thrust element includes an off-center curved ramp that comes into sliding contact with the shutter. The shutter may be turnable and the thrust element stationary, or vice versa.

In a practical embodiment, the thrust element may be formed by a mounting part for receiving the dispenser member and for mounting in stationary manner on a fluid reservoir. In addition, the dispenser duct may be formed by a rotary insert for being rotatably mounted on the outlet of the dispenser member, the dispenser orifice being secured to a rotary actuator member that turns relative to the thrust element. Advantageously, the insert forms at least one cam path for moving a pusher axially by turning the actuator member. Preferably, the actuator member is in the form of an outer shell that includes a side hole through which the dispenser orifice passes, and a top opening through which the pusher passes. Combining the shutter of the invention with a telescopic pusher is particularly advantageous, since the user turns the outer shell so as to cause the pusher to extend outwards and retract inwards, without even realizing that this operation causes the dispenser duct to be opened and/or closed. In this way, the shutter of the invention reproduces one of the characteristics of an internal shutter, whereby the user is not even aware of its presence and of its action.

In a practical embodiment, the shutter may comprise: a closure tip for coming into leaktight contact against a seat that is formed in the dispenser duct; a thrust zone for coming into contact with the thrust element so as to thrust the tip into contact with the seat; and a flexible membrane for urging the tip away from the seat. The thrust zone is advantageously situated at the end remote from the closure tip. The flexible membrane preferably closes the dispenser duct at its end remote from the dispenser orifice.

The present invention also defines a fluid dispenser comprising a fluid reservoir, a fluid dispenser member, such as a pump or a valve, and a dispenser head as defined above. The head is preferably mounted on the dispenser member and/or on the reservoir.

The spirit of the invention resides in the shutter being situated inside the dispenser duct, but being actuatable from the outside of the duct by means of a thrust element that is a part that is distinct from the shutter, and that moves substantially perpendicularly, or at least transversally, to the movement direction of the shutter in the duct. The relative movement between the shutter and the thrust element may be rectilinear, or in translation, or even rotary. The shutter may be turned, while the thrust element remains stationary.

The invention is described more fully below with reference to the accompanying drawings, which show an embodiment of the invention by way of non-limiting example.

Figure 2:
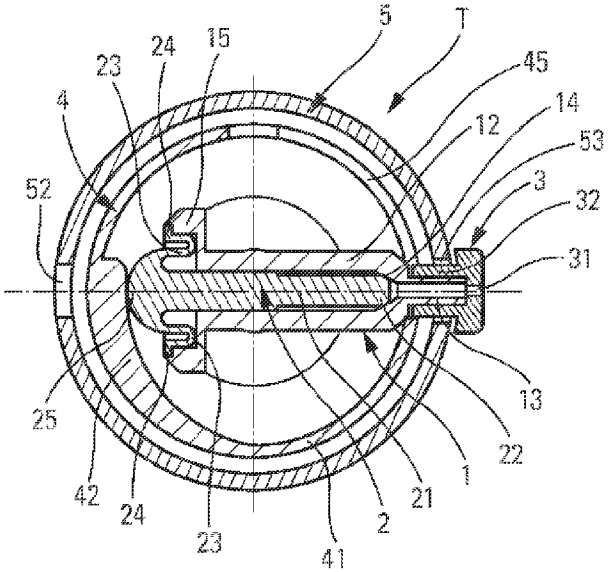
FIG. 2 is a horizontal cross-section view on section line A-A in FIG. 1.
Figure 1:
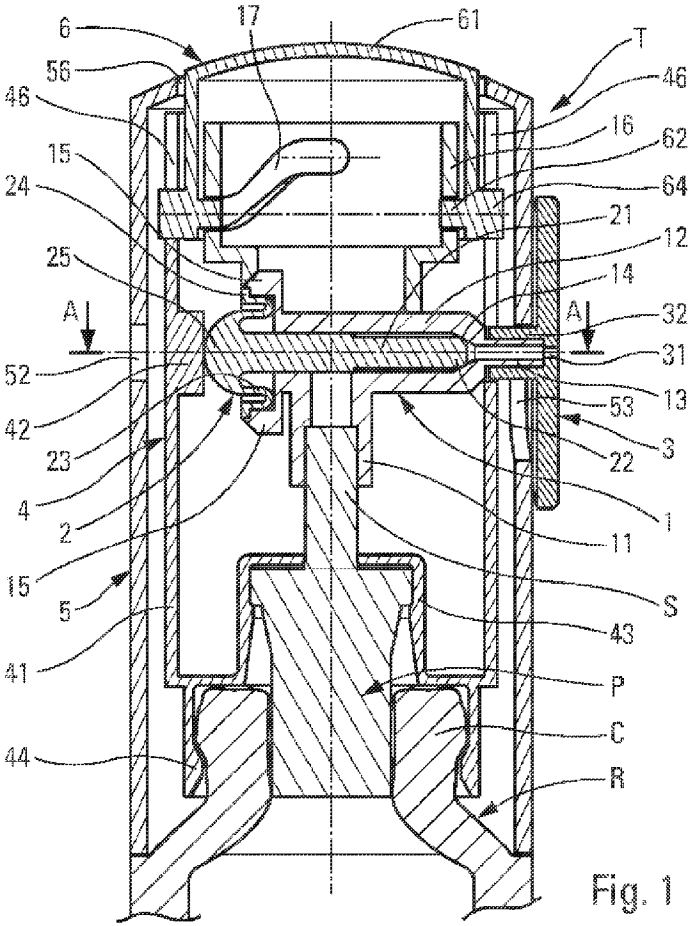
FIG. 1 is a vertical section view through a fluid dispenser including a dispenser head of the invention in its closed position.
Figure 3:
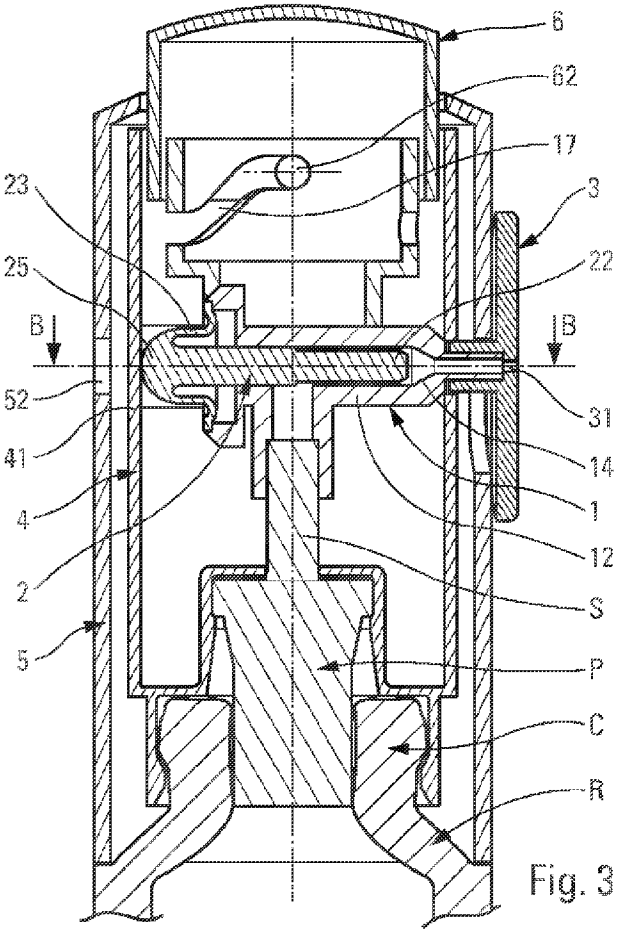
FIG. 3 is a view similar to the view in FIG. 1 with the dispenser head in its dispensing position.

Reference is made to all of FIGS. 1 to 4 in order to describe the structure and the operation of a dispenser incorporating a dispenser head in a non-limiting embodiment of the invention. FIGS. 1 and 3 show a fluid dispenser, although the reservoir R is only shown in part. The fluid dispenser may be used in the fields of perfumery, cosmetics, and pharmacy in order to dispense various fluids, such as perfumes, creams, lotions, gels, etc. The dispenser comprises three main subassemblies, namely the fluid reservoir R, a dispenser member P, and a dispenser head T. The reservoir R and the dispenser member P are not critical for the present invention, and they are not described in detail. The reservoir R includes a neck C that forms an opening giving access to the inside of the reservoir. Advantageously, the neck C may form an outer annular reinforcement that serves as a fastener profile for the dispenser head T. The dispenser member P may be a pump or a valve and comprise a body and an outlet S that may be in the form of an actuator rod that is axially movable down and up inside the body. The body is held stationary in the neck C of the reservoir R.

The dispenser head T, that is the subject of the present invention, comprises a plurality of component elements, namely a rotary insert 1, a shutter 2, a dispenser bib 3, a mounting part 4, an outer shell 5, and a pusher 6. All of the component elements of the dispenser head T may be made by injection-molding plastics material that is hard to a greater or lesser extent. Certain component elements may also be made of metal, such as the dispenser bib 3, the outer shell 5, and/or the pusher 6, for example.

The rotary insert 1 is a complex part that is made up of a plurality of portions that perform distinct functions. Firstly, the insert 1 forms an axial connection sleeve 11 that is fitted on the free top end of the outlet S of the dispenser member P. The connection sleeve 11 is connected to a dispenser duct 12 that extends substantially or completely perpendicularly to the connection sleeve 11. At one of its ends, the dispenser duct 12 forms a seat 14 that is extended by an outlet cannula 13. At its opposite end, the dispenser duct 12 forms an anchor collar 15. The insert 1 also forms a top portion in the form of a bushing 16 that is substantially cylindrical and that includes one or more openings in the form of cam path(s) 17. By way of example, it is possible to provide two cam paths 17 in the bushing 16.

A major fraction of the shutter 2 is inserted into the dispenser duct 12 and includes a main stem 21 that is terminated at one end by a tip 22 for coming into selective leaktight contact with the seat 14 that is formed by the duct 12. At its opposite end, the main stem 21 forms a thrust zone 25 that is extended over its outer periphery by a flexible membrane 23 that presents a certain amount of springiness, like a spring. At its free end, the membrane 23 forms a leaktight anchor rim 24 that is in leaktight engagement with the anchor collar 15 formed by the rotary insert 1. As a result of its springy flexibility, the membrane 23 allows the shutter 2 to move inside the dispenser duct 12 along a horizontal axis of movement. It can also be said that the membrane 23 closes the duct 12 in leaktight manner at its end remote from the seat 14. From the outlet S of the dispenser member P, the fluid passes through the connection sleeve 11 and arrives in the dispenser duct 12 and may spread out from the seat 14 to the membrane 23. The way in which the shutter 2 is pressed against the seat 14 is described below.

The dispenser bib 3 is an optional part. It forms a dispenser orifice 31 that is arranged to extend the cannula 13 of the rotary insert 1. The dispenser orifice may also be formed by the free end of the cannula 13. The dispenser bib 3 makes it possible to configure the dispenser orifice 31 more accurately, and also to give the dispenser head T an attractive appearance. The bib 3 includes a sleeve 32 that may merely be force-fitted around the cannula 13.

Figure 4:
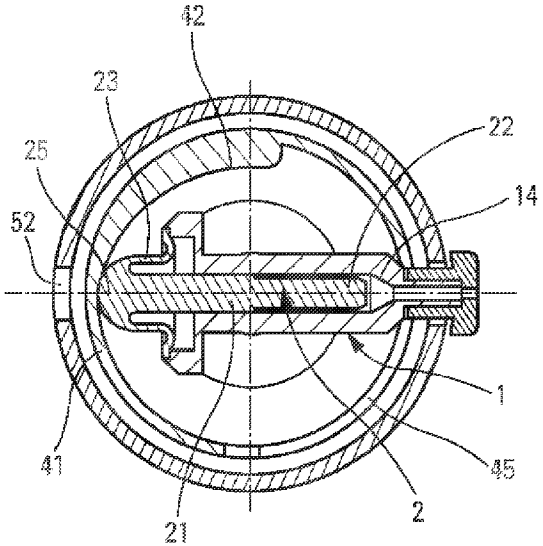
FIG. 4 is a view similar to the view in FIG. 2 on section line B-B in FIG. 3.

The mounting part 4 is also a complex part that performs a plurality of functions. Firstly, the mounting part 4 includes a main section 41 that is substantially cylindrical and that is extended at its bottom end by a fastener ring 44 that is in engagement with the neck C of the reservoir R. The mounting part 4 also defines a reception housing 43 for receiving the dispenser member P. The reception housing 43 is formed coaxially inside the main section 41. At its top end, the main section 41 forms two axial slots 46 that open upwards. The main section 41 also forms a radial window 45, visible in FIGS. 2 and 4, for moving the rotary insert 1. The radial window 45 may communicate with one of the axial slots 46, as can be seen in FIG. 1. Finally, the main section 41 defines a thrust element 42 for coming into contact with the thrust zone 25 of the shutter 2, as can be seen in the various figures. By way of example, the thrust element 42 may be in the form of an off-center ramp that progressively projects into the main section 41 so as to reach a maximum. This is clearly visible in the various figures. In FIG. 2, the thrust zone 25 is situated at the maximum of the ramp 42, while in FIG. 4, the thrust zone 25 is situated at the foot of the ramp 42. By comparing the various figures, it should easily be understood that the shutter 2 and the thrust element 42 move mutually in turning relative to each another along a vertical longitudinal axis that is perpendicular to the axis of movement of the shutter 2. As a result, sliding contact is established between the thrust zone 25 and the thrust element 42. In FIGS. 1 and 2, the thrust zone 25 is pushed hard by the thrust element 42, such that the flexible membrane 23 is deformed to its maximum and the tip 22 is in leaktight bearing contact against the seat 14, thereby closing the dispenser duct 12. Passage between the outlet S of the dispenser member P and the dispenser orifice 31 is thus prevented. In FIGS. 3 and 4, it can be seen that the thrust zone 25 is not pushed by the thrust element 42, such that the flexible membrane 23 can relax and move the tip 22 away from the seat 14. Thus, the fluid may find a passage from the outlet S of the dispenser member P to the dispenser orifice 31.

The flexible membrane 23 thus acts like a return spring to move the tip 22 away from the seat 14. The thrust element 42 serves to stress the flexible membrane 23 in such a manner as to move and finally press the tip 22 against the seat 14. Naturally, in order to go from a closed position to a dispensing position, it is necessary to perform a turning movement between the shutter 2 and the mounting part 4.

In a variant, the membrane 23 may push the tip 22 against the seat 14, even in the absence of thrust from the thrust element 42. In this configuration, the shutter is opened with the arrival of fluid under pressure on each actuation. The thrust element thus performs a simple function of locking and unlocking the shutter, but does not control it.

The outer shell 5 performs an actuator member function, making it possible to turn the shutter 2 relative to the mounting part 4. To do this, the outer shell 5 includes a side hole 53 through which there pass both the cannula 13 of the rotary insert 1 and the sleeve 32 of the dispenser bib 3. The side hole 53 is oblong so as to enable limited axial movement of the dispenser orifice 31 while the dispenser head is being actuated. As a result, turning the outer shell 5 about its own axis takes the dispenser orifice 31 with it, and consequently turns the rotary insert 1 and the shutter 2 together with the outer shell 5. The rotary insert 1 may be turned on the outlet S between the insert 1 and the outlet S, or, in a variant, the insert 1 may also cause the outlet S to turn. At its top end, the outer shell 5 defines a large through opening 56 for the pusher 6, as described below.

In summary, the outer shell 5 makes it possible to turn the rotary insert 1 and its shutter 2 about the longitudinal axis that is perpendicular to the axis of movement of the shutter. However, given that the mounting part 4 is mounted in stationary manner on the neck C by means of its ring 44, relative turning is performed between the outer shell 5 and the mounting part 4, and, as a result, between the mounting part 4 and the shutter 2. The outer shell 5 thus causes the shutter 2 to turn relative to the thrust element 42 which remains stationary relative to the reservoir R. In other words, the thrust element 42 is movable substantially perpendicularly and tangentially to the axis of movement of the shutter 2.

The user may thus act on the shutter 2 by turning the outer shell 5. The user is not even aware of the existence of the mounting part 4, which part is housed entirely inside the shell 5. The same applies for the rotary insert 1, which is not visible from the outside. It is possible to provide a visual indicator for the user in the outer shell 5 in the form of a small window 52 in the thrust zone 25. The small viewing window gives access to the mounting part 4 that may include the word OFF when the head T is in the position shown in FIGS. 1 and 2, and the word ON when the dispenser head is in the position shown in FIGS. 3 and 4.

The pusher 6 is the part that the user uses to actuate the dispenser head and, as a result, the dispenser member P. The pusher 6 includes a top bearing surface 61 on which the user may press axially by means of one or more fingers. The pusher 6 also includes a side skirt that is substantially cylindrical and that internally forms two cam lugs 62 that are in engagement in the cam paths 17 of the bushing 16. Externally, the skirt forms two axial guide lugs 64 that are in engagement in the axial slots 46 of the main section 41 of the mounting part 4. In this way, the pusher 6 is guided axially in the axial slots 46 without performing a turning movement. In addition, the pusher 6 is constrained to move axially as a result of the engagement of the cam lugs 62 in the cam paths 17. Given that the bushing 16 turns in the main section 41, the pusher 6 is thus subjected to an axial movement in translation without any turning component when the outer shell 5 is turned.

In use, the user uses the outer shell 5 to move the pusher 6 axially, so as to cause it to extend outwards so as to be able to press thereon. This is the functional and visual effect that the user seeks on turning the outer shell 5. However, in this way, the user also acts on the shutter 2, moving it relative to the off-center ramp of the thrust element 42. The shutter 2 thus passes from its closed position shown in FIGS. 1 and 2 to its dispensing position shown in FIGS. 3 and 4. On turning the outer shell 5, the user is not even aware of acting on a shutter, since the user does not even know it exists. Thus, combining a shutter of the invention with a telescopic pusher as described above is particularly advantageous, since the shutter is actuated even without the user realizing it. For the user, action seems to be taken only on the telescopic pusher, but in reality it is also taken on a shutter.

In addition, the mechanism for axially moving the telescopic pusher 6 is a characteristic that may be protected in itself, i.e. independently of the shutter of the invention.

It should also be observed that the pusher is locked in the configuration in FIG. 1, and unlocked and thus actuatable in the configuration in FIG. 3. As a result, the shutter of the invention may also advantageously be associated with any rotary locking and unlocking system for the pusher, such as that of document FR 2 819 793, for example, preventing the pusher from moving axially in a locked position and allowing it to move axially in an actuation position, the pusher moving from one position to the other by turning about its own axis.

The invention provides a shutter that is incorporated in the dispenser duct, but that is actuatable from the outside by means of a distinct thrust element that is movable tangentially and/or perpendicularly relative to the shutter.

The invention claimed is:

1. A fluid dispenser head for associating with a fluid dispenser member, the head forming a dispenser duct that communicates upstream with an outlet of the dispenser member, and downstream with a dispenser orifice, the head further including a shutter for selectively closing the dispenser duct, the shutter being movable in the duct along a movement axis between a closed position and a dispensing position, the head further including a thrust element so as to thrust the shutter towards its closed position, wherein the thrust element is movable substantially perpendicularly to the movement axis of the shutter.

2. The dispenser head according to claim 1, wherein the thrust element is situated outside the feed duct.

3. The dispenser head according to claim 1, wherein the thrust element is movable tangentially in turning relative to the shutter.

4. The dispenser head according to claim 3, wherein the thrust element includes an off-center curved ramp that comes into sliding contact with the shutter.

5. The dispenser head according to claim 1, wherein the thrust element is formed by a mounting part for receiving the dispenser member and for mounting in stationary manner on a fluid reservoir.

6. The dispenser head according to claim 1, wherein the dispenser duct is formed by a rotary insert for being rotatably mounted on the outlet of the dispenser member, the dispenser orifice being secured to a rotary actuator member that turns relative to the thrust element.

7. The dispenser head according to claim 6, wherein the insert forms at least one cam path for moving a pusher axially by turning the actuator member.

8. The dispenser head according to claim 7, wherein the actuator member is in the form of an outer shell that includes a side hole through which the dispenser orifice passes, and a top opening through which the pusher passes.

9. The dispenser head according to claim 1, wherein the shutter comprises:

a closure tip for coming into leaktight contact against a seat that is formed in the dispenser duct;

a thrust zone for coming into contact with the thrust element so as to thrust the tip into contact with the seat; and a flexible membrane for urging the tip away from the seat.

10. A fluid dispenser comprising a fluid reservoir, a fluid dispenser member, and a dispenser head according to claim 1, mounted on the dispenser member and on the reservoir.

11. The device according to claim 1, further including a locking system for locking the pusher, preventing the pusher from moving axially in a locked position and allowing the pusher to move axially in an actuation position, the pusher moving from one position to the other by turning about an axis of the pusher.

12. The dispenser head according to claim 1, wherein the fluid dispenser member is a pump or a valve.

13. The fluid dispenser according to claim 10, wherein the fluid dispenser member is a pump or a valve.

* * * * *